US007905993B2

(12) United States Patent
Funahashi

(10) Patent No.: US 7,905,993 B2
(45) Date of Patent: Mar. 15, 2011

(54) CORROSION CONTROL METHOD AND APPARATUS FOR REINFORCING STEEL IN CONCRETE STRUCTURES

(76) Inventor: Miki Funahashi, West Chester, PA (US)

( * ) Notice: Subject to any disclaimer, the term of this patent is extended or adjusted under 35 U.S.C. 154(b) by 663 days.

(21) Appl. No.: 11/942,955

(22) Filed: Nov. 20, 2007

(65) Prior Publication Data

US 2009/0127132 A1 May 21, 2009

(51) Int. Cl.

| | |
|---|---|
| ***C23F 13/08*** | (2006.01) |
| ***C23F 13/12*** | (2006.01) |
| ***C25B 11/04*** | (2006.01) |
| ***C25B 11/06*** | (2006.01) |
| ***C25B 11/08*** | (2006.01) |
| ***C25B 11/10*** | (2006.01) |

(52) U.S. Cl. ..... 204/196.18; 204/291; 204/290.12; 204/290.13; 204/290.14; 204/196.37; 204/196.38; 204/280

(58) Field of Classification Search ..... 204/196.18, 204/196.19, 280, 291, 196.37, 196.38, 290.12, 204/290.13, 290.14

See application file for complete search history.

(56) References Cited

U.S. PATENT DOCUMENTS

| | | | | |
|---|---|---|---|---|
| 2,498,493 | A | 2/1950 | Hickernell | |
| 3,202,596 | A | 8/1965 | Canevari | |
| 3,260,661 | A | 7/1966 | Kemp et al. | |
| 3,475,213 | A | 10/1969 | Stow | |
| 3,505,144 | A | 4/1970 | Kilduff et al. | |
| 4,496,444 | A | 1/1985 | Bagnulo | |
| 4,812,212 | A | 3/1989 | Dimond et al. | |
| 4,855,024 | A | 8/1989 | Drachnik et al. | |
| 5,292,411 | A * | 3/1994 | Bartholomew et al. | 205/731 |
| 5,411,646 | A | 5/1995 | Gossett et al. | |
| 5,650,060 | A | 7/1997 | Huang et al. | |
| 5,779,632 | A | 7/1998 | Dietz et al. | |
| 5,879,817 | A * | 3/1999 | Brown et al. | 428/629 |
| 6,562,229 | B1 | 5/2003 | Burgher et al. | |
| 2005/0236279 | A1* | 10/2005 | Vaelitalo | 205/734 |

* cited by examiner

*Primary Examiner* — Bruce F Bell

(74) *Attorney, Agent, or Firm* — Gifford, Krass, Sprinkle, Anderson & Citkowski, P.C.

(57) ABSTRACT

Mixed-metal-oxide (MMO) coated precious-metal tape is installed directly on concrete surfaces using an electrically conductive adhesive, thereby obviating the need for slots, holes, cementitious grout or additional concrete. The electrically conductive adhesive is preferably formed by disposing mixed-metal-oxide (MMO) coated precious-metal particles in an adhesive layer. The tape anodes may be installed on the concrete surfaces including a shallow concrete cover or congested reinforcing steel without developing an electrical short circuit between the anode and the reinforcing steel. Overall the invention provides for quick and low cost installation on many concrete structures. Interconnections between the tape anodes and bare metal distribution elements may be made with conductive adhesive or spot welding.

20 Claims, 2 Drawing Sheets

CORROSION CONTROL METHOD AND APPARATUS FOR REINFORCING STEEL IN CONCRETE STRUCTURES

FIELD OF THE INVENTION

This invention relates generally to corrosion control in reinforced-concrete structures and, in particular, to mixed-metal-oxide (MMO) coated precious-metal tape that may be installed directly on concrete surfaces without the need for slots, holes, cementitious grout or concrete.

BACKGROUND OF THE INVENTION

Cathodic protection is a method for controlling corrosion of reinforcing steel in chloride contaminated concrete. Various types of impressed current cathodic protection anodes for reinforced concrete structures have been developed in the past. The anode is one of the most critical components for a cathodic protection system and used to distribute cathodic protection current to the reinforcing steel.

One of the most effective and durable anodes is made of a material which is resistance to corrosion, for example a mixed-metal-oxide (MMO) coated titanium substrate. MMO coated anodes are manufactured by coating a mixture of precious metal oxides on a specially treated precious metal. The coated substrate undergoes multiple thermal treatments at elevated temperatures to gain good bonding properties between the substrate and the coating. Although titanium is widely used as substrate material due to its resistance to corrosion, resistance to chemical attacks and high mechanical strength, other anodes such as tantalum, niobium and zirconium anodes are also used globally for different applications.

Since the first MMO-coated titanium anode was developed in 1984, many concrete structures have been protected using this material. To install the anodes, however, they must be embedded in concrete or cementitious grout. For example, titanium mesh with a concrete overlay, titanium ribbon or ribbon mesh embedded in cemetitious grout in saw-cut slots, or discrete anodes embedded in grout in drilled holes. However, these types of the installation add some burden to the structure and some durability concerns. A useful review of MMO-coated anodes and installation techniques may be found in "Cathodic Protection of Steel in Concrete" By Paul Chess, Taylor & Francis (1998), ISBN 0419230106, the entire content of which is incorporated herein by reference.

The overlay concrete cathodic protection system causes additional dead load to the structure. Frequent disbonding between the overlay and existing concrete is also a serious problem. For the slotted or discrete types of system, the existing concrete must be cut or drilled to install the anodes. However, when the concrete covers over the reinforcing steel are shallow or congested, installation of these types of the systems is not feasible. Even if the anodes are somehow installed in the slots or drilled holes, the vicinity of the reinforcing steel near the anodes may cause an electrical short circuit, resulting in malfunction of the cathodic protection system.

SUMMARY OF THE INVENTION

This invention overcomes the shortcomings of prior art by allowing mixed-metal-oxide (MMO) coated precious-metal tape to be installed directly on concrete surfaces without the need for slots, holes, cementitious grout or concrete. In the preferred embodiment, an electrically conductive adhesive is used to bond the tape to the surface of the concrete. The electrically conductive adhesive is preferably formed by disposing mixed-metal-oxide (MMO) coated precious-metal particles in a rubberized adhesive.

According to the invention, MMO-coated tape anodes may be installed on the concrete surfaces including a shallow concrete cover or congested reinforcing steel without developing an electrical short circuit between the anode and the reinforcing steel. Overall the invention provides for quick and low cost installation on many concrete structures. Interconnections between the tape anodes and bare metal distribution elements may be made with conductive adhesive or spot welding.

DETAILED DESCRIPTION OF THE INVENTION

The invention disclosed concerns the protection and the prevention of corrosion of reinforced concrete structures using mixed-metal-oxide (MMO) coated precious-metal tape anodes. In the preferred embodiment, the tape anode is attached to a concrete surface using a conductive adhesive. More particularly, MMO-coated precious-metal powders are introduced into epoxy or other adhesive, including a rubberized adhesive, capable of bonding the anode tape to concrete.

An appropriate rubberized adhesive may be similar to that used for clear packing tape. Because this is electrically non-conductive, the current from the MMO tape does not transfer to the concrete underneath. However, if the MMO-coated particles have diameters larger than the thickness of the dried adhesive film, some portions of the particles are exposed through the adhesive layer. As such, when the tape is compressed on the concrete surface, the particles make acceptable contact to the concrete. By including enough particles in the adhesive, the contact resistance between the MMO tape and the concrete is sufficiently low enough to provide adequate cathodic protection.

The substrate metal tape anode may be composed of titanium, tantalum, zirconium, niobium. However, the most preferred metal is titanium or titanium alloys because of the corrosion resistance and availability. The tape anode width is preferably over 5 mm and the thickness is in the range of 0.001 mm to 1 mm, preferably between 0.1 mm to 0.3 mm.

The conductive adhesive uses precious-metal powders coated with mixed metal oxides of titanium, tantalum, iridium, ruthenium, palladium, cobalt or mixtures of the same. As with the body of the anode itself, the metal substrate of the powder may be titanium, tantalum, zirconium, niobium, or alloys thereof.

The size of the powder may ranges from 10 to 1000 mesh. By mixing the MMO-coated powders in the adhesive, the contact electrical resistance between the tape anode and the existing concrete is low enough to flow the cathodic protection current into the reinforcing steel through the concrete electrolyte.

Figure 1:
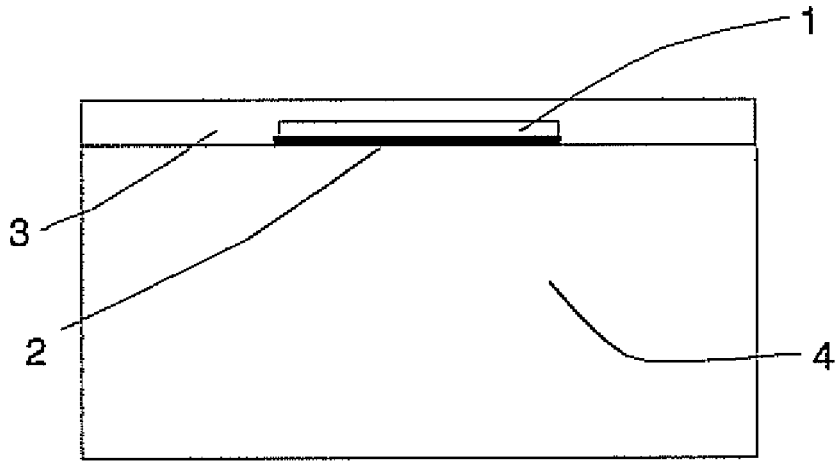
FIG. 1 illustrates a tape anode installation and protection of the tape anode using an optional over-coating.
Figure 2:
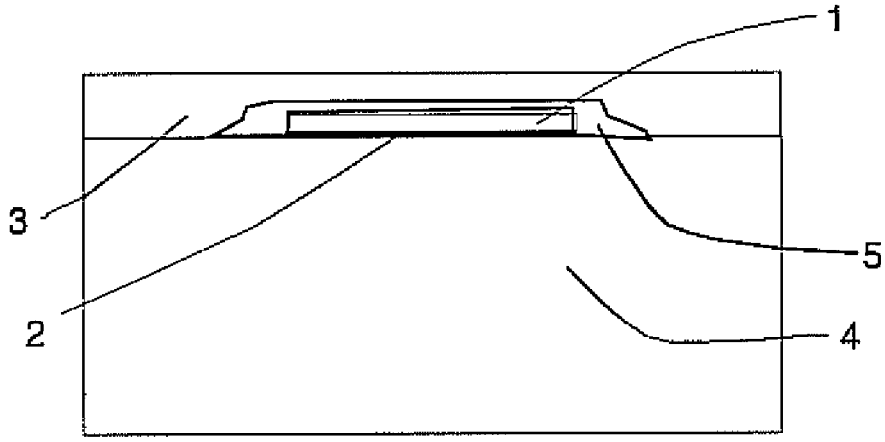
FIG. 2 illustrates the tape anode installation and protection of the tape anode using an optional coating and non-conductive overlay.

FIG. 1 is a simplified cross-sectional diagram showing a metal tape anode 1 attached concrete 4 through conductive adhesive 2. To reinforce the bonding durability of the tape anode to the concrete for a longer period of time, an optional concrete coating, water proof membrane, liner, or cap 3 may be used to cover the tape anode. Furthermore, as shown in FIG. 2, solid or mesh tape 5 may be placed over the tape anode with or without coating 3 to further reinforce the durability of the anode tape. The tape 5 may be FRP (fiberglass-reinforced plastic) or other non-conductive material.

Figure 3:
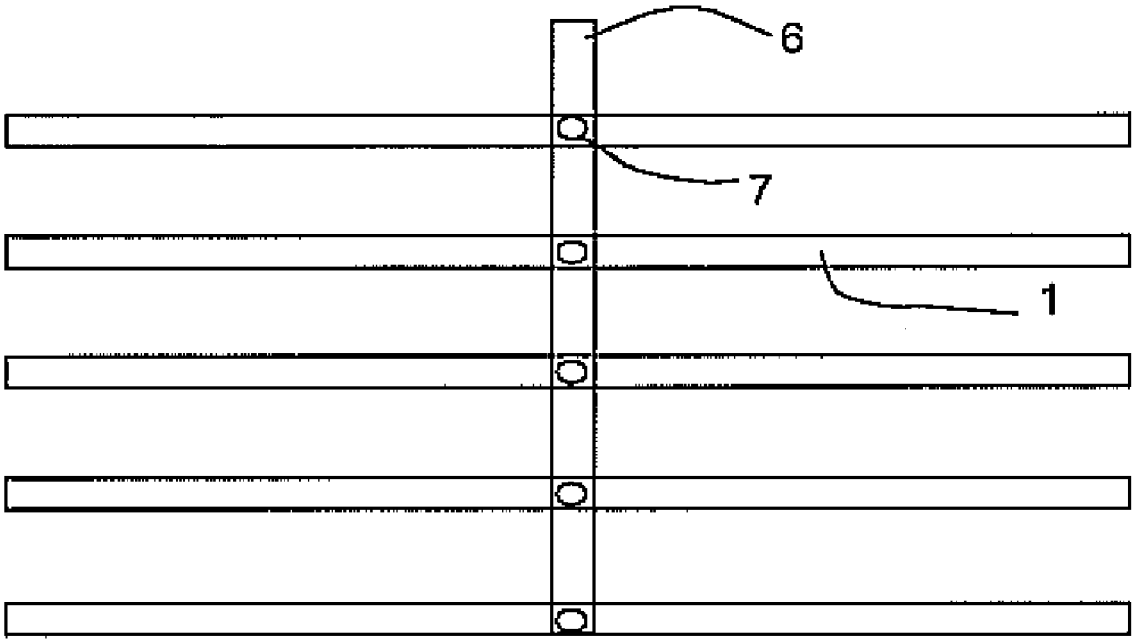
FIG. 3 is an example of a possible installation method of tape anodes to a bare-metal element.

The anode tapes are typically spaced on concrete surfaces according to the cathodic protection current requirement for the reinforcing steel in concrete. The spacing is also based on the current distribution to the reinforcing steel. As shown in FIG. 3, the tape anodes may be electrically interconnected at points 7 to bare metal tapes 6 by means of spot welding or conductive adhesive. The "bare" metal tape may be the same metal as the tape anode or different materials may be used.

I claim:

1. An anode for controlling corrosion of reinforcing steel in concrete, comprising:

a mixed-metal-oxide (MMO) coated precious-metal substrate;

an electrically conductive adhesive layer which dries to bond the substrate to an exposed concrete surface; and wherein the electrically conductive adhesive layer includes metal particles which reduce the contact resistance between the MMO-coated substrate and the concrete when the adhesive dries.

2. The anode of claim 1, wherein the MMO-coated substrate is in the form of an elongate tape.

3. The anode of claim 1, wherein the metal particles are mixed-metal-oxide (MMO) coated precious-metal particles.

4. The anode of claim 1, including metal particles with diameters that are greater than the thickness of the adhesive layer.

5. The anode of claim 1, wherein the precious-metal substrate is composed of titanium, tantalum, zirconium, niobium or alloys thereof.

6. The anode of claim 1, wherein:

the precious-metal substrate is composed of titanium, tantalum, zirconium, niobium or alloys thereof; and the coating is composed of oxides of titanium, tantalum, iridium, ruthenium, palladium, or cobalt.

7. The anode of claim 1, wherein the electrically conductive adhesive includes mixed-metal-oxide (MMO) coated particles composed of titanium, tantalum, zirconium, niobium or alloys thereof.

8. The anode of claim 1, wherein:

the electrically conductive adhesive includes mixed-metal-oxide (MMO) coated particles composed of titanium, tantalum, zirconium, niobium or alloys thereof; and the particles are coated with oxides of titanium, tantalum, iridium, ruthenium, palladium, or cobalt.

9. The anode of claim 1, wherein the electrically conductive adhesive includes mixed-metal-oxide (MMO) coated particles in the range of 10 to 1000 mesh.

10. The anode of claim 1, wherein the MMO-coated substrate is in the form of an elongate tape having a width of 5 mm or greater and a thickness in the range of 0.001 mm to 1 mm.

11. The anode of claim 1, further including a cement cap covering the MMO-coated substrate bonded to the exposed cement surface.

12. The anode of claim 1, further including a non-conductive layer covering the MMO-coated substrate bonded to the exposed cement surface.

13. The anode of claim 1, further including a layer of fiberglass-reinforced plastic (FRP) covering the MMO-coated substrate bonded to the exposed cement surface.

14. The anode of claim 1, wherein the MMO-coated substrate is interconnected to a bare metal tape.

15. The anode of claim 1, wherein the MMO-coated substrate is interconnected to a bare metal tape using an electrically conductive adhesive.

16. The anode of claim 1, wherein the MMO-coated substrate is spot-welded to a bare metal tape.

17. The anode of claim 1, including a plurality of substrates spaced-apart on the concrete according to a cathodic protection current requirement for the reinforcing steel in the concrete.

18. The anode of claim 1, wherein the metal particles are mixed-metal-oxide (MMO) coated precious metal particles with diameters that are greater than the thickness of the adhesive layer.

19. The anode of claim 1, wherein the adhesive layer is a rubberized adhesive into which the metal particles are introduced.

20. The anode of claim 1, wherein the adhesive layer is an epoxy-based adhesive into which the metal particles are introduced.

* * * * *